US006176456B1

(12) United States Patent
Wisniewski

(10) Patent No.: US 6,176,456 B1
(45) Date of Patent: Jan. 23, 2001

(54) KEYBOARD SUPPORT MECHANISM

(75) Inventor: Michael G. Wisniewski, North East, PA (US)

(73) Assignee: Weber Knapp Company, Jamestown, NY (US)

( * ) Notice: Under 35 U.S.C. 154(b), the term of this patent shall be extended for 0 days.

(21) Appl. No.: 09/189,525

(22) Filed: Nov. 10, 1998

(51) Int. Cl.[7] ..... A47F 5/00
(52) U.S. Cl. ..... 248/281.11; 248/918
(58) Field of Search ..... 248/281.11, 284.1, 248/286.1, 279.1, 918, 118, 118.1, 118.3; 108/6, 7, 9

(56) References Cited

U.S. PATENT DOCUMENTS

| | | | | |
|---|---|---|---|---|
| 142,263 | * | 8/1873 | Morrison | 248/281.11 |
| 274,223 | | 3/1883 | Redman . | |
| 714,694 | | 12/1902 | Holtz . | |
| 1,176,272 | * | 3/1916 | Bultman | 248/281.11 |
| 3,436,046 | | 4/1969 | Valeska | 248/284 |
| 4,616,798 | | 10/1986 | Smeenge et al. | 248/281.1 |
| 4,691,888 | * | 9/1987 | Cotterill | 248/284.1 |
| 5,211,367 | * | 5/1993 | Musculus | 248/279.1 |
| 5,292,097 | | 3/1994 | Russell | 248/281.1 |
| 5,398,622 | * | 3/1995 | Lubinskas et al. | 248/281.11 X |

FOREIGN PATENT DOCUMENTS

| | | | | |
|---|---|---|---|---|
| 120853 | * | 1/1946 | (AU) | 248/279.1 |

* cited by examiner

*Primary Examiner*—Anita M. King
(74) *Attorney, Agent, or Firm*—Simpson, Simpson & Synder, L.L.P.

(57) ABSTRACT

A keyboard support mechanism employs a mounting member adapted to be fixed to a base, such as a desk or table top; a support adapted to support a keyboard; upper link having its front and rear ends connected to the support and mounting member by first and second pivot pins; a lower link having its front end connected to the support by a third pivot pin and its rear end formed with a bearing surface slidiably and pivotally enagaging the second pivot pin; and a locking device for selectively maintaining the support at a desired vertical position relative to the mounting member, wherein such locking device includes a downwardly facing planar locking surface on the mounting member and an upwardly facing curved locking surface on the rear end of the lower link.

40 Claims, 4 Drawing Sheets

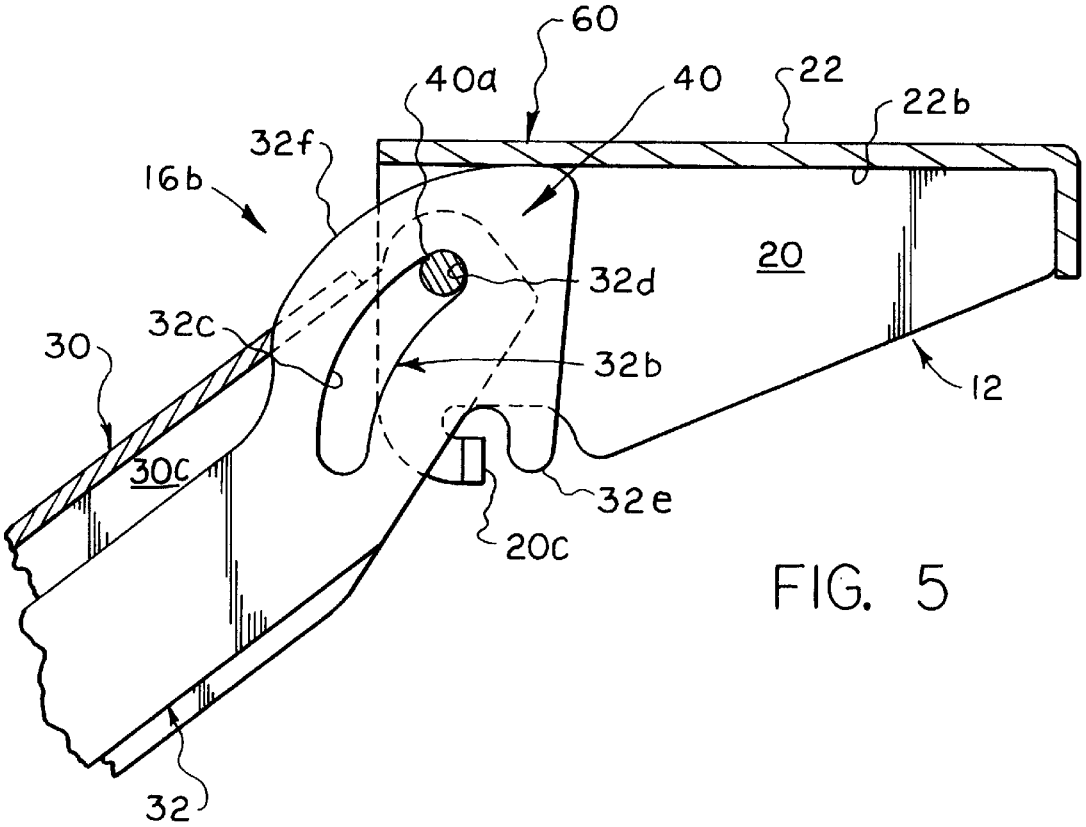
FIG. 5
FIG. 6
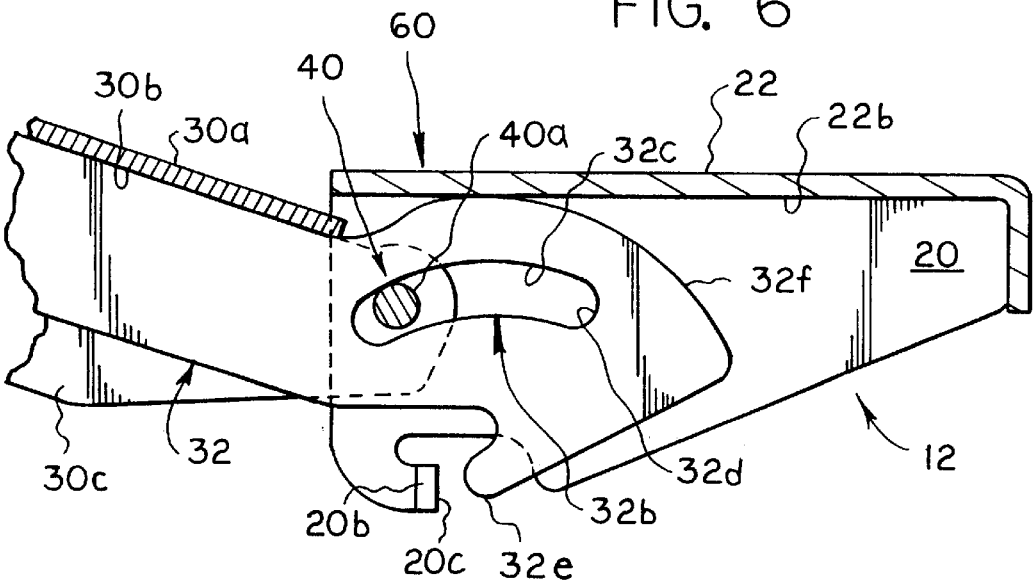

KEYBOARD SUPPORT MECHANISM

BACKGROUND OF THE INVENTION

It is well known to provide a support mechanism including a four bar or parrallelogram linkage to support an art device, such as a keyboard, for vertically swinging movement relative to a base, such as a wall, desk top or table top, between lower and upper use positions; and a locking device to releasably retain the art device in a desired position. Typically, the linkage includes upper and lower links, a first end link for mounting a keyboard support, a second end link fixed to the base and pivot connections for pivotally connecting the ends of the links for pivotal movement about four parallel pivot axes; and the locking device includes a pair of cooperating members carried by the links.

In a commonly assigned patent application entitled KEYBOARD MOUNTING MECHANISM and filed Nov. 5, 1998, there is disclosed an improved mechanism, wherein a parallelogram linkage is pivotally mounting by one of its pivot connections on a separate base mounting member, and a locking device includes members carried by the linkage and mounting member.

SUMMARY OF THE INVENTION

The present convention is directed to an improved keyboard support mechanism in which a three-bar linkage is employed in place of a conventional four-bar linkage for mounting a keyboard support for vertical swinging movement relative to a base in combination with a locking mechanism releasable for permitting vertical movement of the keyboard support upon the application of a lifting force thereto.

BRIEF DESCRIPTION OF THE DRAWINGS

The nature and mode of operation of the present invention will-now be more fully described in the following detailed description taken with the accompanying drawings wherein:

FIG. 5 is a sectional view taken generally along the line 5—5 in FIG. 4;

FIG. 6 is a sectional view taken generally along the line 6—6 in FIG. 4, but showing the mechanism swung upwardly into its upper use position of FIG. 2.

DETAILED DESCRIPTION

Figures 1, 3:
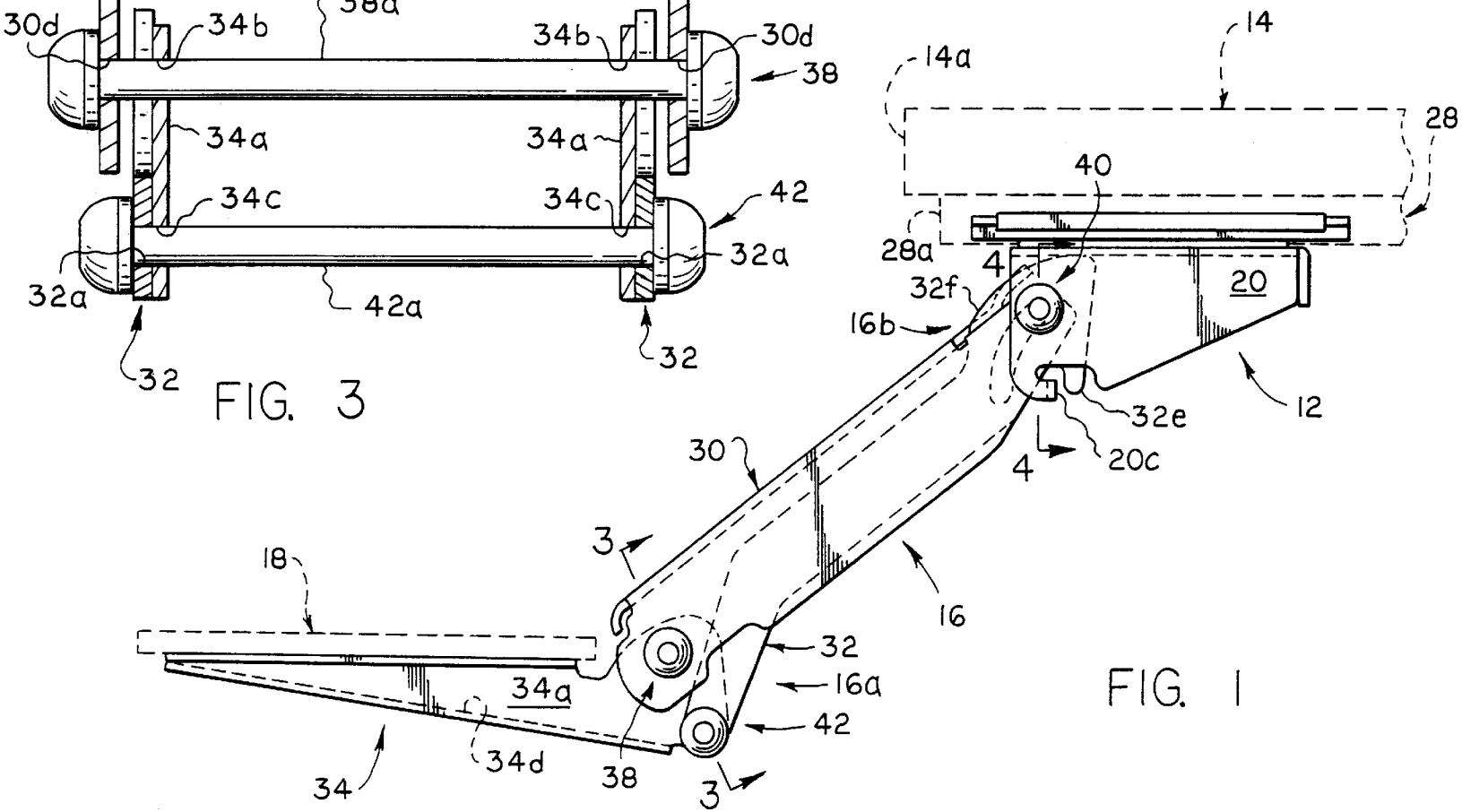
FIG. 1 is a side elevational view of a keyboard support mechanism of the present invention while disposed in a lower use position.
FIG. 3 is a sectional view taken generally along the line 3—3 in FIG. 1.
Figure 4:
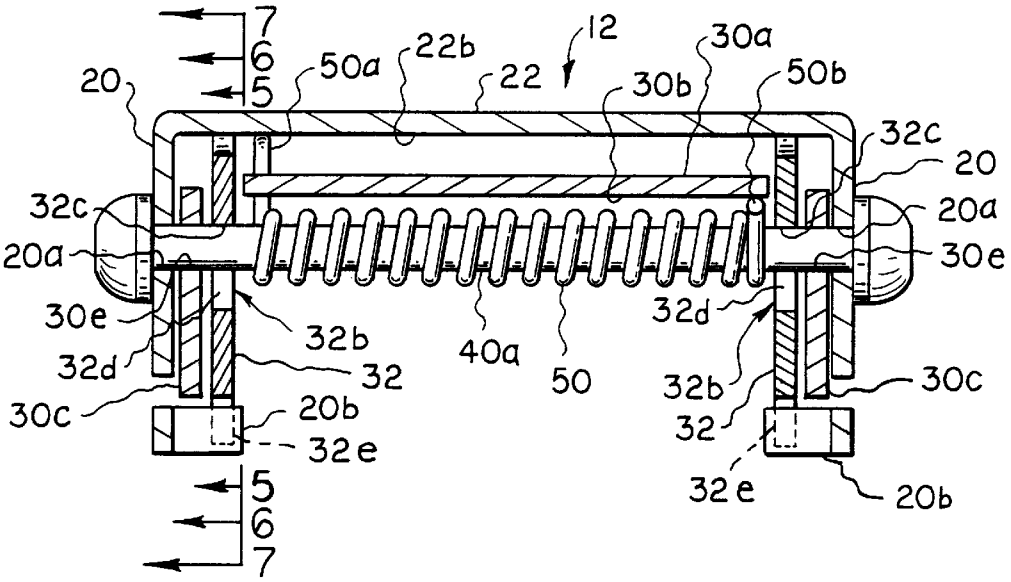
FIG. 4 is a sectional view taken generally along the line 4—4 in FIG. 1.
Figure 2:
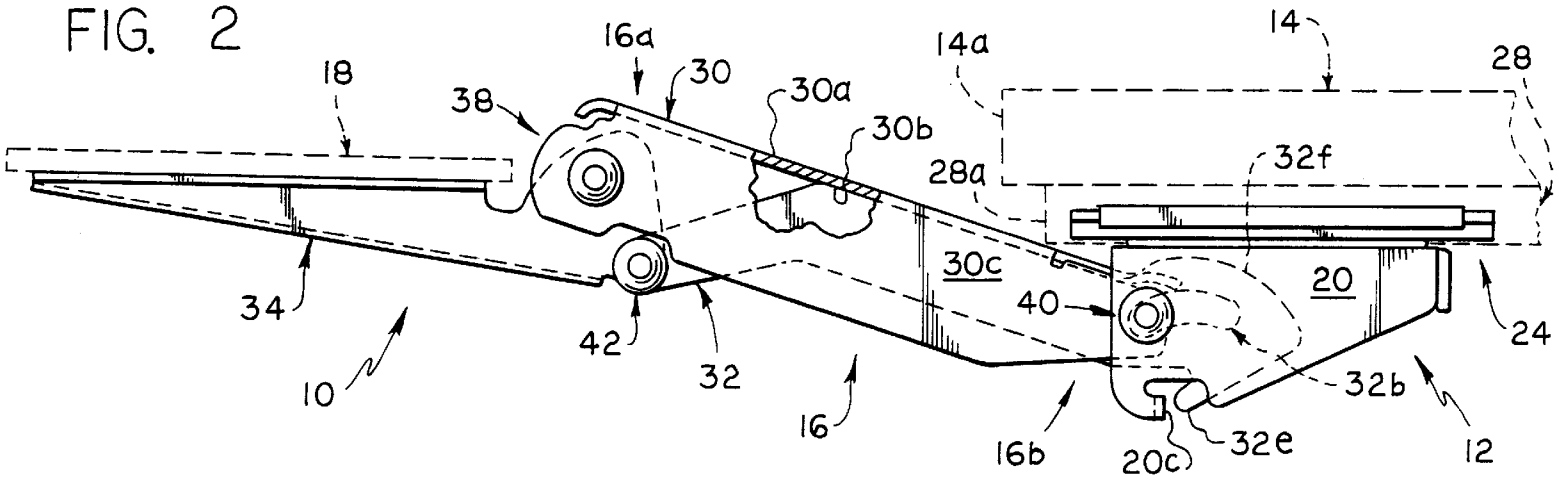
FIG. 2 is a side elevational view of a keyboard support mechanism of the present invention while disposed in upper use position.

Reference is first made to FIGS. 1 and 2, wherein a keyboard supporting mechanism of the present invention is generally designated as 10 and shown as including a mounting member 12 adapted to be fixed to a base, such as a table or desk top or other work surface shown in broken line as 14; and a three bar linkage 16 having a first or front end 16*a* for mounting a keyboard support shown in broken line at 18 and a second or rear end 16*b* connected to mounting member 12 for permitting vertical swinging movement of the three bar linkage and thus keyboard support relative to the mounting member between lowermost and uppermost use positions shown in FIGS. 1 and 2, respectively.

Mounting member 12 is shown as being in the form of an inverted U-shaped bracket having side walls 20,20 and a connecting top wall 22. As is conventional, top wall 22 may be suspended below base 14 by an intermediate bracket 24 for pivotal movement about a vertically disposed axis or for both pivotal movement and sliding movement normal to the base front edge 14*a* by a base affixed guide track, which is generally designated at 28 and enclosed at its front end with a track guard 28*a*. Alternatively, top wall 22 may be non-movably fixed directly to the lower surface of base 14.

Bracket side walls 20,20 are formed with aligned bore openings 20*a*,20*a*, and inturned flanges 20*b*,20*b*, which serve to define aligned and rearwardly facing, abutment surfaces 20*c*,20*c*. Bracket top wall 22 is provided with a downwardly facing surface 22*b*.

Three bar linkage 16 is shown as including an inverted U-shaped upper or first link 30; a pair of lower or second links 32,32; a first end or third link 34 adapted to be suitably fixed to keyboard support 18; and first, second and third pivot connections 38, 40 and 42, respectively, serving to pivotally interconnect the links for relative pivotal or swinging movement about parallel axes. As will be apparent, a pair of links may replace upper link 30, and a single link may replace the pair of lower links 32, 32.

Upper link 30 has a connecting flange 30*a* defining a lower abutment surface 30*b*; and a pair of parallel side wall flanges 30*c*,30*c*, which are formed adjacent linkage first end 16*a* with a pair of aligned bore openings 30*d*,30*d* and adjacent linkage second end with a pair of aligned bore openings 30*e*,30*e*. Lower links 32,32 are formed adjacent linkage first end 16*a* with a pair of aligned bore openings 32*a*,32*a*; and adjacent linkage second end 16*b* with pairs of aligned bearing openings 32*f*,32*f*, which define bearing surfaces 32*c*,32*c* and end abutment surfaces 32*d*,32*d*; downwardly projecting abutment fingers 32*e*,32*e*; and curved edge surfaces 32*f*,32*f*.

First end link 34 is shown in FIGS. 1, 2 and 3 as having a pair of generally L-shaped side wall flanges 34*a*, 34*a* formed with a pair of upper, aligned bore openings 34*b*, 34*b* and a pair of lower, aligned bore openings 34*c*,34*c*; and a connecting flange 34*d*. Side wall flanges 34*a*,34*a* are provided with mounting openings, not shown, for attachment of support 18. Alternatively, first end link 34 may be employed solely to pivotally couple upper link 30 to lower links 32, and a separate intermediate link, not shown, employed to couple support 18 to pivot connections 38 and 42 in order to permit adjustable negative and positive tilting movements of the support relative to linkage first end 16*a*, as disclosed in above-mentioned commonly-assigned patent application whose disclosure is incorporated herein by reference. The term negative tilt means tilting of support 18 away from an operator or clockwise of linkage end 16*a*, as viewed in FIG. 1, and positive tilt means tilting towards the operator.

First pivot connection 38 is preferably defined by fitting a first pivot pin 38*a* within bore openings 30*d*,30*d* and 34*b*,34*b*. Second pivot connection 40 is preferably defined by fitting a second pivot pin 40*a* within bore openings 20*a*,20*a* and 30*e*,30*e* and third pivot connection 42 is preferably defined by fitting a third pivot pin 42*a* within bore openings 32*a*,32*a* and 34*c*,34*c*. Second pivot pin 40*a* is also arranged to pass through bearing openings 32*f*,32*f*.

While one or more of pivot pins 38*a*, 40*a* and 42*a* may be replaced by pairs of short, axially aligned stub pivot shafts, it is preferable to employ the illustrated elongated, pivot pin arrangement in view of strength considerations, and for the case of second pivot pin 40*a* to provide means for mounting a coil spring 50 having opposite ends 50*a* and 50*b* arranged to bear on mounting member surface 22*b* and upper link lower surface 30*b*, respectively. Spring 50 may be employed to counterbalance a portion of the weight of linkage 16 and support 18 in order to facilitate lifting of the support by an operator.

Mechanism 10 additionally includes a locking device 60, which is adapted to lock support 18 in a desired use position under the influence of gravity and to be released or unlocked to permit downward movement of the support by the application of a manual lifting force to the support.

Figure 7:
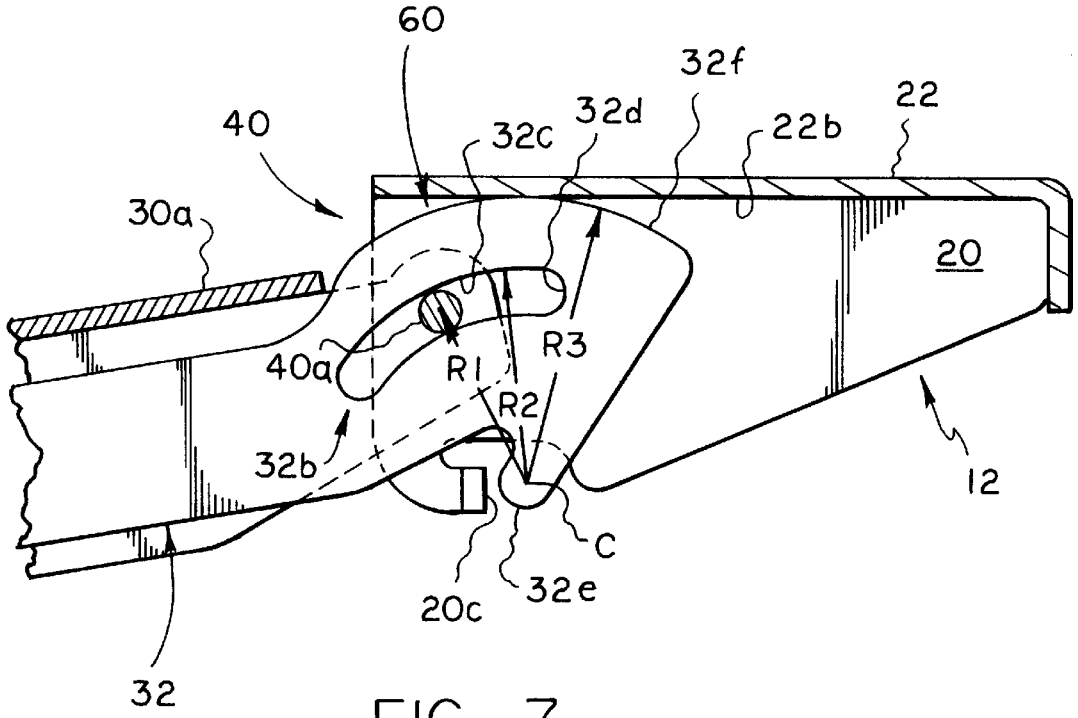
FIG. 7 is a sectional view taken generally along the line 7—7 in FIG. 4, but showing the mechanism in an intermediate position.

In the presently preferred construction, bearing surfaces 32*c*,32*c* are downwardly facing, concave surfaces arranged for sliding movement transversely of and pivotal movement about pivot pin 40*a*; and locking device includes a first locking surface defined by above mentioned upwardly facing convex link surfaces 32*f*, 32*f*, hereinafter locking surfaces 32*f*, 32*f*; and a second locking surface defined by above mentioned planar and downwardly facing mounting member surface 22*b* hereinafter locking surface 22*b*. Preferably, bearing surfaces 32*c*,32*c* and locking surfaces 32*f*,32*f* are concentric and arranged relative to locking surface 22*b*, so as to enable the present three-bar linkage to function as a parallelogram linkage, wherein the whole of linkage swings about single pivot 40*a* and support 18 is disposed in essentially constant attitude, which is preferably horizontal, in all of its vertically spaced use positions. Specifically, this may be achieved by an arrangement shown in FIG. 7, wherein the center of pivot pin 40*a*; bearing surfaces 32*c*,32*c*; and locking surfaces 32*f*,32*f* are spaced through distances $R_1$, $R_2$ and $R_3$ from a given center of curvature C. The placement of center of curvature C corresponds to that of a fourth pivot axis of a parallelogram linkage, which would be formed by adding a fourth link, not shown, to the three-bar linkage defined by first link 30, second link 32, and first end link 34, that is, a four-bar linkage where the length of second link 32, as measured between the axis of pivot pin 42*a* and the axis of such fourth pivot pin, is equal to the length of first link 30, as measured between the axes of pivot pins 38*a* and 40*a*, and the length of such fourth link, as measured between the axes of pivot pin 40*a* and such four pivot pin, is equal to the length of first end link 34, as measured between the axes of first pivot pin 38*a* and third pivot pin 42*a*. Having established the value of $R_1$, the value of $R_2$ can be determined by selection of the diameter of pivot pin 40*a*. For a given set of values of the distances between the axis of second pivot pin 40*a* and surface locking 22*b*, and between the axis of the second pivot pin and center of curvature C, the value of $R_3$ may be selected on a trial and error basis, so as to cause support 18 to assume an essentially horizontal attitude in its various use positions. For smaller values of $R_3$, support 18 would be forced to assume a positive tilt, and for larger values of $R_3$, the support would be forced to assume a negative tilt. It is contemplated that the above values may be made larger and smaller and the above surfaces changed in a multitude of ways in order to provide desired constant or variable orientations of support 18 in its lower and upper use positions, as well as all positions therebetween.

To facilitate description of the operation of mechanism 10, as thus far described, it will be assumed that keyboard support 18 resides in its above described lowermost use position shown in FIG. 1. In this position, the right hand end of locking surfaces 32*f*,32*f* engage with locking surface 22*b*; the right hand end of bearing surfaces 32*c*,32*c* and end abutment surfaces 32*d*,32*d* engage with second pivot pin 40*a*; and the upper surface of support 18 lies essentially horizontal. Two possible modes of operation are presented for purposes of moving support 18 upwardly into a selected use position, namely, an operator may grip and lift the support while maintaining same in its original horizontal orientation, or an operator may simply lift the support, while permitting the support to assume a negative tilt, as an incident to which locking surfaces 32*f*,32*f* are swung away from frictional locking engagement with locking surface 22*b* in a direction extending clockwise about a point of engagement of surfaces 32*c*,32*c* with pivot pin 40*a*, as viewed in FIG. 5. The extent of negative tilt may be limited for instance by engagement of the ends of fingers 32*e*,32*e* with abutment surfaces 20*c*,20*c*.

In the first mode of operation, the locking surfaces 32*f*,32*f* slide forwardly across locking surface 22*b* and the force of gravity is effective to automatically lock support 18 in any elevated use position whenever the lifting force is removed.

In the second mode of operation, it is necessary for an operator to tilt support 18 forwardly or in a positive sense about the axis of first pivot pin 38*a* to again assume its initial horizontal attitude, when a desired use position has been reached and before releasing the lifting force, since lower link locking surfaces are not returned for frictional locking engagement with locking surface 22*b* until the support is returned to its initial horizontal attitude. In either mode of operation, the portions of locking surfaces 32*f*,32*f* presented for contact with locking surface 22*b* for locking purposes, and of bearing surfaces 32*c*,32*c* presented for engagement with pivot pin 40*a*, progressively move to the left, or counterclockwise, as sequentially viewed in FIGS. 5, 7 and 6, until the uppermost use position is reached. This latter position may be variously defined, as for example, by engagement of link 30 with track guard 28*a*.

When it is desired to move support 18 downwardly into a lower use position, an operator is required to grip the support and then tilt same rearwardly or in the direction of negative tilt sufficiently to remove lower locking surfaces 32*f*,32*f* from locking engagement with surface 22*b*, lower the support to a desired use position, and then tilt the support forwardly to again assume its horizontal attitude in order to effect reengagement of locking surfaces 32*f*,32*f* with locking surface 22*b*.

While the present invention is particularly adapted for mounting a keyboard, it will be understood that it is equally adapted for supporting any other art device, such as a work surface for use as a writing surface, or for supporting a mouse pad, which is desired to be moved vertically between a number of use positions.

What is claimed is:

1. A mechanism for mounting a support for an art device for vertical swinging movement relative to a base comprising: a mounting member adapted for connection to said base; a three bar linkage having a first end adapted for connection to said support and a second end connected to said mounting member for mounting said support for vertical swinging movement relative to said mounting member between lower and upper positions, and said linkage consisting of first, second and third links and first, second and third pivot means, said first link having a first end coupled by said first pivot means to said third link for pivotal movement about a first axis and a second end coupled by said second pivot means to said mounting member for pivotal movement about a second axis, said second link having a first end coupled by said third pivot means to said third link for pivotal movement about a third axis disposed parallel to said first and second axes and a second end supported on said mounting member solely by said second pivot means for sliding movement transversely of and for pivotal movement about said second axis; and locking means responsive to gravity for retaining said support in a selected vertical position immediate said lower and upper positions and responsive to a lifting force applied to said support for releasing said locking means to permit said support to undergo movement towards said lower position.

2. A mechanism according to claim 1, wherein the attitude of said support is essentially constant throughout the extent of movement thereof between said lower and upper positions.

3. A mechanism according to claim 1, wherein said locking means includes a pair of locking surfaces gravitationally biased into locking engagement with one another.

4. A mechanism according to claim 3, wherein said locking surfaces are adapted to frictionally engage with one another.

5. A mechanism according to claim 1, wherein said locking means includes a first locking surface carried by said second link and a second locking surface carried by said mounting member.

6. A mechanism according to claim 5, wherein said locking surfaces are adapted to frictionally engage with one another.

7. A mechanism according to claim 1, wherein said second pivot means includes a pivot pin received within aligned bearing openings in said first link and said mounting member and an opening in said second link defining a bearing surface arranged for sliding and pivotal engagement with said pivot pin.

8. A mechanism according to claim 7, wherein said locking means includes a first upwardly facing locking surface carried by said second link and a second downwardly facing locking surface carried by said mounting member.

9. A mechanism according to claim 8, wherein said locking surfaces are adapted to frictionally engage with each other.

10. A mechanism according to claim 7, wherein said bearing surface is a concave surface; and said locking means includes an essentially planar downwardly facing locking surface on said mounting member and a convex upwardly facing locking surface on said second link and arranged to removably frictionally engage with said locking surface of said mounting member to releasably lock said support in a position intermediate said lower and upper positions.

11. A mechanism according to claim 10, wherein said bearing and convex locking surfaces are essentially concentric and arranged to maintain said support in essentially a horizontal attitude in said lower and upper positions and positions therebetween.

12. A mechanism for mounting a support for an art device for vertical swinging movement relative to a base comprising: a mounting member for attachment to said base and defining a downwardly facing locking surface; a three bar linkage having a first end adapted to be connected to said support and a second end connected to said mounting member for mounting said support for vertical swinging movement relative to said mounting member between lower and upper positions, said linkage consisting of first, second and third links and first, second and third pivot means defining first, second and third pivot axes, respectively, said first link having a first end connected to said third link by said first pivot means and a second end connected to said mounting member by said second pivot means; said second link having a first end connected to said third link by said third pivot means and a second end supported on said mounting member solely by said second pivot means said second pivot means including a single pivot pin means for constraining said first link for pivotal movement about said second pivot axis and a bearing surface carried by said second end of said second link and arranged to bear against said single pivot pin means for both pivotal movement about said second pivot axis and for sliding movement transversely of said second pivot axis said second link having a link locking surface, said link locking surface being arranged to removably engage with said mounting member locking surface, the force of gravity tending to swing said link locking surface into engagement with said mounting member locking surface about a point of engagement of said bearing surface with said single pivot pin means for releasably retaining said first link against downwardly directed swinging movement about said second pivot axis, and said link locking surface is removed from locking engagement with said mounting member locking surface to permit downwardly directed swinging movement of said first link about said second pivot axis by manual application of lifting force to said support means.

13. A mechanism according to claim 12, wherein said bearing surface is defined by an edge of a slot having one end engageable with said single pivot pin means for defining a limit of said downwardly directed swinging movement of said first link.

14. A mechanism according to claim 12, wherein said bearing surface and said link locking surface are curved and said mounting member locking surface is essentially planar.

15. A mechanism according to claim 14, wherein said bearing surface and said link locking surface are essentially concentric and are arranged to maintain said support in an essentially horizontal attitude in vertical positions thereof in which said first link is retained against said downwardly directed swinging movement.

16. A mechanism according to claim 15, wherein said bearing surface is defined by a slot having one end arranged to engage with said single pivot pin means for defining a limit of said downwardly directed swinging movement of said first link.

17. A mechanism according to claim 12, wherein said second link and said mounting member are provided with removably engaging abutments for limiting negative tilting movement of said support about said first pivot axis.

18. A mechanism according to claim 12, wherein said single pivot pin means is a pivot pin received within bore openings of said mounting member and said second end of said first link and an opening in said second end of said second link, and said opening in said second link having a downwardly facing edge defining said bearing surface.

19. A mechanism according to claim 18, wherein said bearing surface and said link locking surface are curved and said mounting member locking surface is essentially planar.

20. A mechanism according to claim 19, wherein said bearing surface and said link locking surface are essentially concentric and are arranged relative to said mounting member locking surface to maintain said support in an essentially horizontal attitude in vertical positions thereof in which said first link is retained against said downwardly directed swinging movement.

21. A mechanism according to claim 20, wherein said opening in said second link has an end arranged for engagement with said pivot pin to define a limit of said downwardly swinging movement of said first link.

22. A mechanism according to claim 21, wherein said second link and said mounting member are provided with removably engaging abutments for limiting negative swinging movement of said support about said first pivot axis.

23. In a mechanism for mounting a support for an art device for vertical movement relative to a base, the improvement comprising: a mounting member for attachment to said base; a three bar linkage having a first end adapted for attachment to said support and a second end attached to said mounting member, said linkage consisting of an upper link, a lower link, an end link, and first, second and third pivot means, said upper link having first and second ends; said lower link having first and second ends, said first ends of said upper and lower links being pivotally connected to said end link by said first and third pivot means for relative pivotal movement about first and third parallel pivot axes, said second pivot means including a common pivot pin means for supporting said second ends of said upper and lower links on said mounting member for pivotal movement about a common second axis arranged parallel to said first and third axes, said second end of said lower link having a bearing surface arranged to slidably and pivotally engage with said common pivot pin means, and locking means having a first locking surface carried by said lower link and a second locking surface carried by said mounting member, said first locking surface being biased by gravity to engage with said second locking surface for retaining said support in a selected vertical position relative to said mounting member, and said first locking surface being adapted to be released from engagement with said second locking surface by the application of manual lifting force to said support.

24. A mechanism for mounting an art device for vertical movement relative to a base comprising: a mounting member for attachment to said base, support means for supporting said art device; a three bar linkage for mounting said support means on said mounting member for vertical swinging movement relative thereto between upper and lower positions, said linkage consisting of an upper link, a lower link, an end link and first, second and third pivot means, said upper link having first and second ends connected to said end link and said mounting member by said first and second pivot means, respectively, for pivotal movement relative to said end link about a first pivot axis and relative to said mounting member about a second pivot axis; said lower link having a first end pivotally connected to said end link by said third pivot means for pivotal movement about a third pivot axis disposed parallel to said first and second pivot axes and a second end pivotally connected to said mounting member by said second pivot means for pivotal movement about said second pivot axis, said second pivot means including a common pivot pin means for constraining said upper link for pivotal movement about said second axis and a bearing surface defined by said lower link, said bearing surface being arranged to bear on said common pivot pin means and undergo both pivotal movement relative thereto about said second pivot axis and sliding movements relative thereto in a direction transversely of said second pivot axis; and locking means for releasably retaining said support means in a selected intermediate position vertically between said lower and upper positions, said locking means including a first locking surface carried by said second end of said lower link and a second locking surface carried by said mounting member, the force of gravity tending to simultaneously maintain said bearing surface engaged with said common pivot pin means and said first locking surface engaged with said second locking surface to releasably lock said support means in said intermediate position, and said first locking surface is released from engagement with said second locking surface to permit said vertical swinging movement of said support means by applying an upwardly directed lifting force to said support means.

25. A mechanism according to claim 24, wherein said bearing surface has first end, second end and intermediate surface portions arranged to respectively engage with said second pivot means when said support means is in said lower, upper and intermediate positions.

26. A mechanism according to claim 24, wherein said bearing surface is a curved surface.

27. A mechanism according to claim 26, wherein said first locking surface is curved and said second locking surface is essentially planar.

28. A mechanism according to claim 24, wherein said support means is maintained in an essentially constant attitude throughout its range of vertically swinging movement.

29. A mechanism according to claim 28, wherein said attitude is essentially horizontal.

30. A mechanism according to claim 24, wherein said mounting member and said lower link have abutment surfaces arranged to engage one another to limit negatively directed tilting movement of said support means relative to said upper link about said first pivot means.

31. A mechanism according to claim 24, wherein said lower link engages with said mounting member to limit positively directed tilting movement of said support means relative to said upper link about said first pivot pin.

32. A mechanism according to claim 31, wherein said mounting member and said lower link have abutment surfaces arranged to engage one another to limit negatively directed tilting movement of said support means relative to said upper link about said first pivot means.

33. A mechanism according to claim 32, wherein said lower link is provided with an abutment surface arranged to engage with said second pivot means to define said lower position.

34. A mechanism for mounting a support for an art device for vertical swinging movement relative to a base comprising:

a mounting means adapted for attachment to said base;

a three bar linkage adapted for attachment to said support and attached to said mounting means for mounting said support for vertical swinging movement relative to said mounting means between upper and lower positions, said linkage having first, second and third links, and first, second and third pivot means, said first and third pivot means connecting said first and second links to said third link for pivotal movement about a pair of parallel pivot axes, said second pivot means connecting said first and second links to said mounting means for pivotal movement about a single pivot axis disposed parallel to said pair of pivot axes, said second pivot means including a pivot pin pivotally supporting said first link on said mounting means and a bearing surface carried by said second link and arranged to face vertically downwardly to bear on said pivot pin and undergo both pivotal movement relative thereto about said single pivot axis and sliding movements relative thereto in a direction extending transversely of said single pivot axis; and locking means responsive to gravity for releasably retaining said support in selected vertical positions intermediate said upper and lower positions, said locking means having a first locking surface carried by said second link and arranged to face vertically upwardly away from said single pivot axis and a second locking surface carried by said mounting means and arranged to face vertically downwardly towards said single pivot axis, said first locking surface being normally maintained in bearing engagement with said second locking surface and said bearing surface being normally maintained in bearing engagement with said pivot pin by the force of gravity on said linkage and said support for retaining said support in said selected vertical positions, and said first locking surface being removed from engagement with said second locking surface to permit vertical movement of said support upon manual application of a lifting force to said support.

35. A mechanism according to claim 34, wherein said bearing surface is concave, said first locking surface is convex, said second locking surface is planar, and said bearing and first locking surfaces are concentric and arranged relative to said second locking surface to enable said linkage to function as a parallelogram linkage characterized in that said support may be disposed in an essentially constant attitude in said selected vertical positions.

36. In a mechanism for movably mounting a support for an art device on a base comprising mounting means adapted for attachment to said base, a linkage having a first end attached to said support and a second end attached to said mounting means for mounting said support for vertical swinging movements relative to said mounting means between upper and lower positions, and locking means for releasably retaining said support in selected vertical positions intermediate said upper and lower positions, the improvement comprising:

said linkage is a three bar linkage consisting of first and second links each having first and second ends, a third link, a pair of pivot means for connecting said first ends to said third link for pivotal movement about a pair of parallel axes, and a single pivot means for connecting said second ends to said mounting means for pivot movement about a single pivot axis disposed parallel to said axes, said single pivot means including a pivot pin means for constraining said second end of said first link for pivotal movement about said single pivot axis and a bearing surface on said second end of said second link arranged to bear on said pivot pin means for both pivotal movement relative thereto about said single pivot axis and for sliding movement relative thereto in a direction transversely of said single pivot axis.

37. The improvement of claim 36, wherein said bearing surface is concave and is arranged to face downwardly towards said pivot pin means, and an abutment surface is arranged adjacent and end of said bearing surface for engagement with said pivot pin means to define said lower position.

38. The improvement of claim 36, wherein the extent of pivotal movement of said support relatively upwardly about that one of said pair of axes about which said first link may pivot relative to said third link is limited by engagement of means carried by said second link and an abutment surface carried by said mounting means.

39. The improvement of claim 36, wherein said bearing surface faces downwardly towards said pivot pin means, and said locking means includes a first locking surface carried by said second end of said second link and arranged to face upwardly away from said pivot pin means and a second locking surface carried by said mounting means and arranged to face downwardly towards said first locking surface and said pivot pin means, and said first locking surface is normally maintained in locking engagement with said second locking surface and said bearing surface is normally maintained in bearing engagement with said pivot pin means by the force of gravity acting on said linkage and said support.

40. The improvement of claim 39, wherein said first locking surface is convex, said second locking surface is planar, and said bearing surface and said first locking surface are concentric and arranged relative to said second locking surface to cause said support to assume a like attitude in each of said intermediate positions.

* * * * *

UNITED STATES PATENT AND TRADEMARK OFFICE

CERTIFICATE OF CORRECTION

PATENT NO. : 6,176,456 B1
DATED : January 23, 2001
INVENTOR(S) : Michael G. Wisniewski It is certified that error appears in the above-identified patent and that said Letters Patent is hereby corrected as shown below:

Column 2,
Line 39, replace "32f, 32f" with -- 32b, 32b --
Line 67, replace "32f, 32f" with -- 32b, 32b --

Signed and Sealed this

Fourth Day of February, 2003

JAMES E. ROGAN
*Director of the United States Patent and Trademark Office*